US006579019B2

(12) United States Patent
Ansell et al.

(10) Patent No.: US 6,579,019 B2
(45) Date of Patent: Jun. 17, 2003

(54) APPARATUS FOR GUIDING A PRINTING HEAD

(75) Inventors: Iain Ansell, Newmarket Suffolk (GB); Steven Roland Brace, Cambridgeshire (GB)

(73) Assignee: Francotyp-Postalia AG & Co., Birkenwerder (DE)

( * ) Notice: Subject to any disclaimer, the term of this patent is extended or adjusted under 35 U.S.C. 154(b) by 107 days.

(21) Appl. No.: 09/793,412

(22) Filed: Feb. 26, 2001

(65) Prior Publication Data

US 2001/0041085 A1 Nov. 15, 2001

(30) Foreign Application Priority Data

Feb. 24, 2000 (DE) ..... 100 09 800

(51) Int. Cl.[7] ..... B41J 25/304

(52) U.S. Cl. ..... 400/76; 400/59; 400/283; 101/71

(58) Field of Search ..... 400/76, 23, 320, 400/283, 352, 354, 355, 59, 319; 347/9, 37; 101/371, 71

(56) References Cited

U.S. PATENT DOCUMENTS

| | | | | |
|---|---|---|---|---|
| 2,651,400 A | * | 9/1953 | Young et al. | 197/2 |
| 3,583,540 A | * | 6/1971 | Bernard | 346/134 |
| 4,774,529 A | | 9/1988 | Paranjpe et al. | |
| 4,930,911 A | * | 6/1990 | Sampson et al. | 101/27 |
| 5,039,233 A | | 8/1991 | Baitz et al. | |
| 6,099,107 A | * | 8/2000 | Ford et al. | 347/104 |
| 2002/0001496 A1 | * | 1/2002 | Ford | 400/76 |

FOREIGN PATENT DOCUMENTS

| | | |
|---|---|---|
| DE | 31 25 426 A1 | 1/1983 |
| DE | 88 14 238.8 | 5/1990 |
| DE | 42 37 275 C1 | 11/1993 |
| DE | 129 22 423 A1 | 11/1999 |
| EP | 0 933 210 A2 | 8/1999 |
| EP | 0 980 761 A1 | 2/2000 |
| EP | 0 980 762 A2 | 2/2000 |
| GB | 2 238 509 A | 6/1991 |

* cited by examiner

*Primary Examiner*—Andrew H. Hirshfeld
*Assistant Examiner*—Kevin D. Williams
(74) *Attorney, Agent, or Firm*—Laurence A. Greenberg; Werner H. Stemer; Gregory L. Mayback

(57) ABSTRACT

A printing apparatus, in particular, a franking machine, includes a base, a printing-head mounting moveably connected thereto, and printing head displaceably connected to the mounting. The mounting moves, during printing, between first and second longitudinal positions in a given direction with respect to the base to effect a relative movement between the printing head and a printing medium. An offsetting device for printing images offset to one another transverse to the given direction is included and is configured to offset the printing head relative to the mounting from a first transverse position into at least one second transverse position spaced from the first transverse position in a direction transverse to the given direction. A holder for holding the printing head in at least one of the first and second transverse positions during printing is provided. The holder has at least first and second holding devices, each of which has at least one stop for limiting movement of the printing-head transverse to the given direction.

13 Claims, 5 Drawing Sheets

APPARATUS FOR GUIDING A PRINTING HEAD

BACKGROUND OF THE INVENTION

Field of the Invention

The invention lies in the field of printing. The invention relates to an apparatus for printing, in particular, a franking and/or a addressing machine, with a printing head that is held displaceably on a printing-head mounting. In order to achieve the relative movement between the printing head and the medium to be printed, the mounting is configured to be movable, during printing, between a first longitudinal position and a second longitudinal position in a first direction with respect to a base element. Also provided is a first offsetting device that allows the printing of printing images offset to one another transversely to the first direction. The offsetting device is configured for offsetting the printing head relative to the printing-head mounting from a first transverse position into at least one second transverse position spaced from the first transverse position transversely to the first direction. In order to hold the printing head in the first or the second transverse position during printing, a holder for holding the printing head in the respective position is provided.

Within the meaning of the invention, the term "printing head" refers to all types of printing devices that can generate a printing image on a medium. In other words, the term, on one hand, includes printing devices employing any desired printing techniques. Nor is it to be restricted to the component that directly generates the printing image, but may additionally embrace further components that are required for generating the printing image. The components may be, for example, ink reservoirs, etc.

A prior art apparatus is disclosed, for example, in European Patent Application EP 0 933 210 A2. In the apparatus described there, the printing head is disposed displaceably in a mounting guided by a guide rod. For printing, the mounting and, therefore, the printing head are moved in a first direction, to be precise, parallel to the guide rod.

When a first printing image has been generated, the printing head is offset relative to the mounting perpendicularly to the first direction, in order, in a further step, to generate a second printing image, with the printing head being moved in the first direction in the opposite sense. The offset of the second printing image to the first printing image is such that the two printing images overlap one another at most in the edge region in which they are contiguous to one another transversely to the first direction. It is, thereby, possible to generate by a printing head an entire printing image of which the dimension transverse to the first direction, that is to say transverse to the printing direction, corresponds approximately to double the printing width of the printing head.

In the prior art apparatus, the offsetting device is disposed on the mounting and is configured as a linear drive that acts on the printing head. Naturally, the linear drive also assumes the function of a holder.

Such a configuration has a disadvantage that the use of the linear drive for holding the printing head in the respective transverse position necessitates a relatively complicated activation of the drive, if appropriate even a position control, in order to ensure exact positioning of the printing head. Moreover, the drive must deliver a particular holding moment in both directions of movement, in order to ensure exact positioning during the printing operation.

SUMMARY OF THE INVENTION

It is accordingly an object of the invention to provide an apparatus for guiding a printing head that overcomes the hereinafore-mentioned disadvantages of the heretofore-known devices of this general type and that, at low outlay, ensures exact and reliable positioning of the printing head during printing.

With the foregoing and other objects in view, there is provided, in accordance with the invention, an apparatus for printing, including a base element, a printing-head mounting moveably connected to the base element, a printing head displaceably connected to the printing-head mounting, the printing-head mounting configured to move, during printing, between a first longitudinal position and a second longitudinal position in a given direction with respect to the base element to effect a relative movement between the printing head and a medium to be printed, an offsetting device for printing images offset to one another transverse to the given direction, the offsetting device configured to offset the printing head relative to the printing-head mounting from a first transverse position into at least one second transverse position spaced from the first transverse position in a direction transverse to the given direction, and a holder for holding the printing head in at least one of the first transverse position and the second transverse position during printing, the holder having at least one first holding device and at least one second holding device, each of the at least one first holding device and the at least one second holding device having at least one stop for limiting movement of the printing-head transverse to the given direction. Preferably, the printing apparatus is a franking machine.

The invention is based on the technical teaching that a particularly simple apparatus with transverse positioning of the printing head, the transverse positioning conforming well to the accuracy requirements, is obtained when the means for holding the printing head in the respective transverse position has at least one first holding device and one second holding device that respectively include at least one stop for limiting the printing-head movement transversely to the first direction.

In accordance with another feature of the invention, at least one holding device has a stop with a stop surface, and the stop is disposed on the printing-head mounting.

In a refinement according to the invention, it is necessary merely for the relative positions of the stop regions disposed on the printing head and the relative positions of the stops cooperating with these to be within specific predetermined tolerances in order to ensure sufficiently exact positioning.

Contact between the stop regions disposed on the printing head and the stops may, in such a case, be punctiform or linear, but, for reasons of wear, it preferably takes place over an area in order to obtain low local surface pressure during contact.

The stops may be disposed fixedly on the apparatus, for example, on the base element. During the movement of the printing head during printing, the respective stop regions on the printing head then brush over the respective stop cooperating with them. Preferably a stop surface of the stop of at least the first holding device is disposed on the printing-head mounting. One advantage is that such a stop is largely free of wear because, during printing, it does not experience any movement relative to the printing head and, therefore, as a rule, has no appreciable tangential forces acting upon it, but, instead, mainly normal forces. Consequently, it does not undergo any appreciable frictional wear.

In accordance with a further feature of the invention, the there is provided a force member for providing a contact force, and at least one holding device is configured to hold the printing head in at least one of the first and second transverse positions by the contact force acting on the stop.

The first holding device holding the printing head in the corresponding transverse position can ensure the transverse positioning of the printing head during printing by positive connection. In order to ensure reliable positioning of the printing head during printing in a simple way, the first holding device is configured preferably for holding the printing head in the associated transverse position by a first contact force acting on the stop.

For such a purpose, in preferred variants of the apparatus according to the invention, a spring device for achieving the first contact force by spring action is provided. The spring device can act directly on the printing head and prestress the printing head against the stop. The prestress and, therefore, the contact force are selected such that the respective stop region of the printing head is constantly pressed against the associated stop during the printing operation.

In further variants, a magnetic device may be provided for achieving the first contact force by magnetic action. A magnet may be provided on the printing head, which, in order to generate the contact force, cooperates with a further magnet or an element of magnetic material, for example, iron or the like, which is disposed preferably in the region of the stop. Alternatively, a corresponding element of magnetic material may also be provided on the printing head, which, in order to generate the contact force, then cooperates with a magnet preferably disposed in the region of the stop.

In accordance with an added feature of the invention, the first holding device is configured to hold the printing head in the associated transverse position by a first locking element acting by positive connection. Then, it is not necessary for the printing head to be prestressed against the respective stop when the locking element acts positively in both directions transversely to the first direction, insofar as the positive connection has sufficiently small play.

It goes without saying that the locking element may also act positively in one direction only, that is to say, forms the stop or the stop region, cooperating with the stop, on the printing head. Then, in order to position the printing head, a corresponding contact force on the stop must also be established in the way described.

Preferably, the first holding device is configured to automatically lock the first locking element when the associated transverse position is reached. At the same time, also preferably, the actuation of the locking element takes place by the movement of the printing-head mounting and, therefore, of the printing head in the first direction. For such a purpose, the locking element may be configured, for example, as a correspondingly shaped lever that is prestressed by spring action and that is actuated, during the movement of the printing-head mounting, by running onto corresponding control elements, for example, simple ramps or the like, for locking or releasing the lock.

The second holding device may be configured in a similar way in the manner of the first holding device. The variants mentioned may, however, also be combined with one another in any desired way.

Simply constructed and, therefore, advantageous developments of the apparatus according to the invention are distinguished in that at least the second holding device includes a first longitudinal guide device and a second longitudinal guide device cooperating with the latter. The second longitudinal guide device cooperates with the first longitudinal guide device such that the printing head is guided essentially parallel to the first direction. Furthermore, at the same time, one of the two longitudinal guide devices is disposed on the base element. A simple configuration is, therefore, implemented that reliably ensures transverse positioning.

The term "longitudinal guide device" within the meaning of the invention embraces any desired device(s) that, when cooperating with a counterpart, influences the direction of the relative movement between the longitudinal guide device and the counterpart.

In favorable developments of the apparatus according to the invention, the first longitudinal guide device has at least one first longitudinal guide surface essentially parallel to the first direction. The second longitudinal guide device is formed by a longitudinal guide element that cooperates with the first longitudinal guide surface in order to hold the printing head in the respective transverse position.

In such a case, during the cooperation of the longitudinal guide devices, the longitudinal guide element brushes over the first longitudinal guide surface. The longitudinal guide element may have a second longitudinal guide surface over which the active partner brushes during the cooperation of the longitudinal guide devices. It is likewise possible, however, for the longitudinal guide element to be configured such that linear or punctiform contact with the first longitudinal guide surface occurs.

As long as contact, that is to say, the action of a contact force, is ensured between the two longitudinal guide devices, a defined movement of the printing head during offsetting is also guaranteed. The contact force may be ensured, for example, by a spring that acts on the printing head.

Preferably, the first longitudinal guide device is formed by a longitudinal guide groove and the second longitudinal guide device is formed by a longitudinal guide pin, thus, resulting in a configuration that is particularly simple to produce and has reliable guidance. Moreover, such a configuration ensures positive guidance, which allows reliable guidance even without any separate prestressing of the two longitudinal guide devices against one another.

In accordance with a concomitant feature of the invention, the longitudinal guide device disposed on the base element extends at least in the region between the first and the second position of the printing-head mounting to ensure, in a simple way, reliable transverse position of the printing head during the printing operation between the first and the second position of the printing-head mounting.

Other features that are considered as characteristic for the invention are set forth in the appended claims.

Although the invention is illustrated and described herein as embodied in an apparatus for guiding a printing head, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
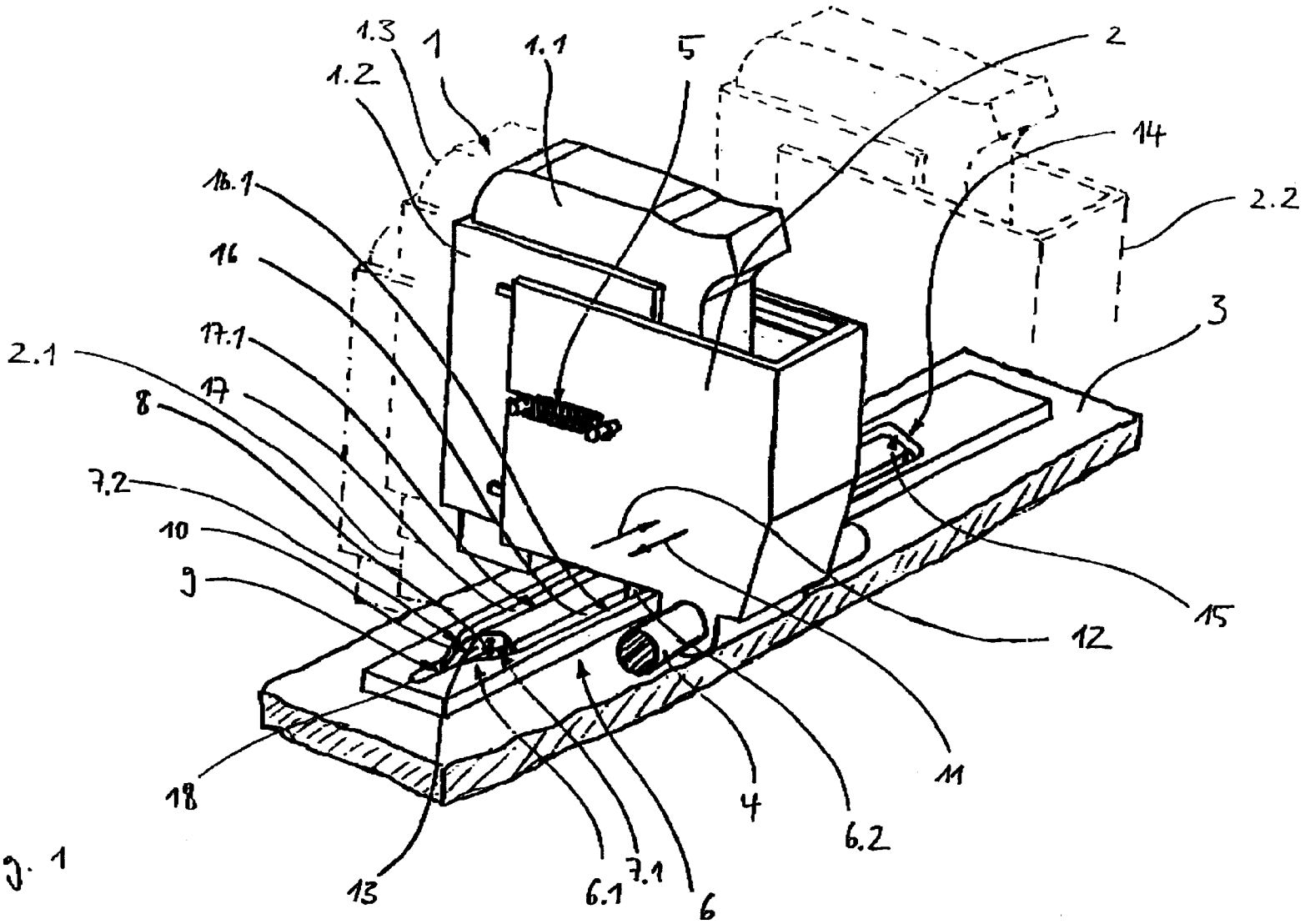
FIG. 1 is a perspective, fragmentary view of a preferred exemplary embodiment of the apparatus according to the invention.

In all the figures of the drawing, sub-features and integral parts that correspond to one another bear the same reference symbol in each case.

Referring now to the figures of the drawings in detail and first, particularly to FIG. 1 thereof, there is shown a fragmentary view of a franking machine with a printing head 1 displaceably held on a printing-head mounting 2. The printing head 1 includes an ink-jet cartridge 1.1 that is mounted exchangeably in a capsule 1.2. The capsule 1.2 is mounted displaceably in the printing-head mounting 2.

During printing, the printing-head mounting 2 is moved between a first longitudinal position and a second longitudinal position in a first direction 11, 12 with respect to a base element 3, as indicated by contours 2.1, 2.2, resulting in a relative movement between the printing head 1 and a non-illustrated medium to be printed. At the same time, a guide rod 4, which is partially illustrated, guides the mounting 2.

The printing head 1 is mounted in the printing-head mounting 2 through the capsule 1.2 such that the printing head 1 is displaceable transversely to the first direction 11, 12. At the same time, the latter is connected to the printing-head mounting 2 by a spring 5 that exerts on it a prestressing force acting in the direction of the guide rod 4.

Also provided is a first offsetting device 6, which offsets the printing head 1 relative to the printing-head mounting 2 from a first transverse position shown in FIG. 1 into a second transverse position, indicated by contour 1.3, spaced from the first transverse position transversely to the first direction 11, 12, thereby making possible printing of printing images offset to one another transversely to the first direction 11, 12.

The first offsetting device 6 is formed by a first guide device 6.1 and a second guide device 6.2. The first guide device 6.1 is, preferably, a guide groove 6.1 in the base element 3. The second guide device 6.2 is, preferably, a guide pin 6.2 disposed on the underside of the capsule 1.2 and that can run in the guide groove 6.1.

The following description relates to the cooperation of the guide groove 6.1 and the guide pin 6.2 relative to one another during movement of the printing-head mounting 2 and, therefore, of the printing head 1 in the first direction 11, 12 in order to offset the printing head transversely to the first direction 11, 12.

The guide groove 6.1 has a Y-shaped run with a first leg 7.1 and a second leg 7.2 that run symmetrically to an axis parallel to the first direction. The side walls of the guide groove 6.1 provide first guide surfaces 8, 9, 10 against which the guide pin 6.2 is pressed due to the prestressing force exerted by the spring 5.

Due to the inclination of the guide surface 8 in relation to the first direction 11, 12, during the movement of the printing-head mounting 2 in the direction of the arrow 11, the guide pin 6.2 is moved away from the guide rod 4 transversely to the first direction 11, 12 and counter to the prestressing force of the spring 5. The printing head 1 is also offset from its first transverse position transversely to the first direction 11, 12 by the guide pin 6.2 because the guide pin 6.2 is fastened fixedly to the capsule 1.2.

When the guide pin 6.2 has traveled through the first leg 7.1 and, consequently, reaches the guide surface 9 after half of the transverse offset to be executed, the direction of movement in the first direction is reversed, that is to say, the printing-head mounting 2 is moved in the direction of the arrow 12.

To ensure that the guide pin 6.2 does not move into the first leg 7.1 again, a lead device 13 is disposed in the transitional region of the legs 7.1 and 7.2 of the guide groove 6.1 and ensures the offsetting movement of the printing head 1 from the first transverse position into the second.

The lead device 13 is a pivoting deflector 13 that is prestressed against the guide surface 8 by a non-illustrated spring device, so that, in the normal state, the deflector 13 closes the first leg 7.1. During movement of the printing-head mounting 2 in the direction of arrow 11, the guide pin 6.2 forces the deflector 13 out of the first leg 7.1 and, therefore, passes the deflector 13. After the guide pin 6.2 passes the deflector 13, the deflector 13 moves again into its normal position, as a result of the prestress, to close the first leg 7.1 and open the second leg 7.2. After the printing-head mounting 2 reverses its movement, the guide pin 6.2, and with it the printing head 1, is offset further transversely to the first direction 11, 12 during the movement of the printing-head mounting 2 in the direction of the arrow 12. The transverse offset is assisted by the guide surface 10, which is disposed, for the most part, at the deflector 13 and is inclined to the first direction, until the guide pin 6.2 reaches its second transverse position at the end of the guide surface 10.

It goes without saying that the deflector 13 may also be configured differently in other variants of the apparatus according to the invention. Thus, for example, it is possible for the deflector 13 not to be produced as a separate component, but by an elastically deformable projection or the like in the guide groove.

The guide groove 6.1 is disposed in the region of the first longitudinal position of the printing-head mounting 2 so that the transverse offsetting of the printing head 1 can take place immediately after the completion of a printing image or before the commencement of a printing image.

In order to offset the printing head 1 from the second transverse position back into the first transverse position, a second offsetting device is provided in the region of the second longitudinal position of the printing-head mounting 2. The second offsetting device is formed by a third guide device in the form of a second guide groove 14 in which the guide pin 6.2 can run once again.

The guide groove 14 has a guide surface 15, against which the guide pin 6.2 is pressed by the spring 5, as a result of the spring 5 prestress. Here, too, the offsetting of the printing head takes place as a result of the inclination of the guide surface 15 to the first direction by a movement of the printing-head mounting 2 in the first direction.

It goes without saying that, in other variants of the invention, other guide devices may also be provided instead of the guide grooves and guide pins. It is likewise possible, in a kinematic reversal, to configure guide elements on the base element and to provide the guide grooves on the printing head.

In order to hold the printing head 1 in its first or second transverse position during printing, that is to say during movement between the first and second longitudinal position, and vice-versa, a holding means is provided. The holding means is formed by a first holding device in the form of a first longitudinal guide groove 16 and by a second holding device in the form of a second longitudinal guide groove 17. The guide grooves 16, 17 are disposed on the base element 2, and, at the same time, adjoin the two guide grooves 6.1 and 14. The guide pin 6.2 also runs in the guide grooves 16, 17.

The two longitudinal guide grooves 16 and 17 run parallel to the first direction 11, 12. They respectively have a longitudinal guide surface 16.1 and 17.1 that is parallel to the first direction 11, 12 and against which the guide pin 6.2 acting as a longitudinal guide element is pressed by the spring 5 prestress when the guide pin 6.2 runs through the respective longitudinal guide groove 16, 17. Thus, the longitudinal guide surfaces 16.1 and 17.1 respectively form a stop for limiting the printing-head movement transversely to the first direction 11, 12.

By virtue of the respective longitudinal guide surfaces 16.1, 17.1 being parallel to the first direction 11, 12, during the movement of the printing-head mounting 2 between the first and the second longitudinal position, and vice-versa, the printing head is guided parallel to the first direction 11, 12 and is, thereby, held in its respective transverse position during printing.

In the example shown, the printing operation has the following sequence. When the franking machine is switched on, the printing head is in its maintenance and parking position, in which the guide pin 6.2 is located at the end 18 of the Y-shaped guide groove 6.1. Then, the printing head 1 is first moved in the direction of arrow 12 until it has reached its second transverse position and the first longitudinal position. The printing head 1 is then moved further on to the second longitudinal position while generating a first printing image. The printing head 1 is subsequently moved further in the direction of arrow 12 until it reaches the guide groove 14. Then, the printing head 1 is offset into its first transverse position by the guide groove 14 while moving in the direction of arrow 11. As soon as the printing head 1 has reached its second longitudinal position again, it is moved further on to the first longitudinal position, at the same time generating a second printing image. The first and the second printing image complete one another to form an entire franking impression. The printing operation is then concluded. The printing head 1 is, thereupon, either moved into its parking position again or is, again, offset into the second transverse position using the guide groove 6.1 so that a new franking impression can be commenced.

Figure 2:
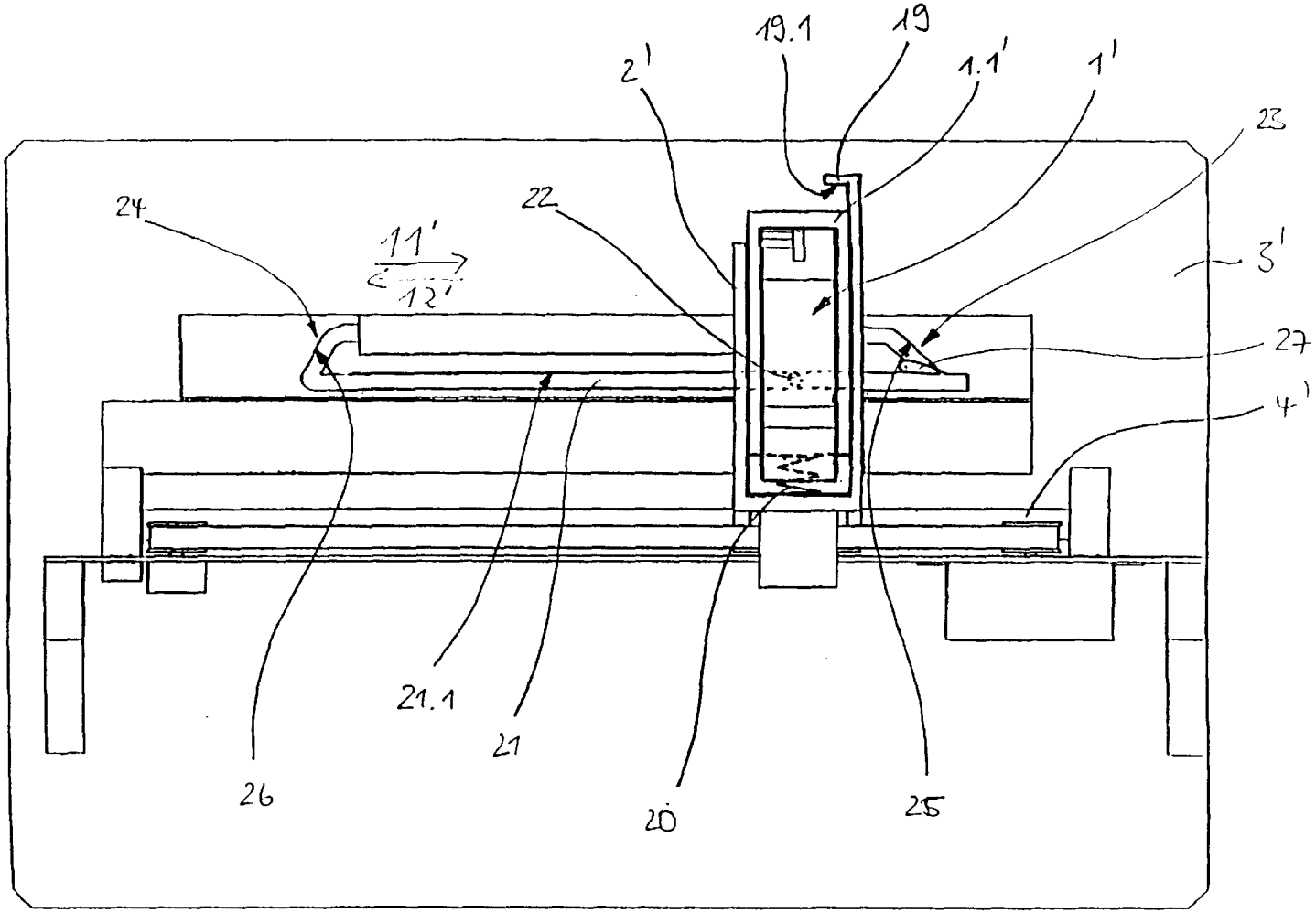
FIG. 2 is a plan view of a further exemplary embodiment of the apparatus of FIG. 1.

FIG. 2 shows a top view of a further exemplary embodiment of the apparatus according to the invention, the basic makeup of which is identical to that from FIG. 1. Accordingly, only the differences are described here.

One difference is the construction of the first holding device formed by a simple stop 19 disposed on the printing-head mounting 2'. The stop 19 provides a stop surface 19.1 for the capsule 1.1' and, thus, limits the printing-head movement transversely to the first direction 11', 12'.

The first holding device furthermore includes a spring device formed by a diagrammatically illustrated spring 20. The spring 20 exerts on the printing head 1' a force directed away from the guide rod 4'. When the printing head 1' bears on the stop surface 19.1 of the stop 19, the spring 20 gives rise, on the stop 19, to a contact force that holds the printing head in its first transverse position.

The second holding device is, again, formed by a longitudinal guide groove 21 that forms, as a stop for limiting the printing-head movement transversely to the first direction 11', 12', a longitudinal guide surface 21.1 parallel to the first direction 11', 12' and intended for the guide pin 22 disposed on the underside of the printing head 1'. Here, too, the spring 20 gives rise to a contact force between the longitudinal guide surface 21.1 and the guide pin 22. The contact force holds the printing head 1' in the second transverse position.

It goes without saying that, in other versions of the apparatus according to the invention, the stop may also be disposed at another location and, in another refinement, on the printing-head mounting 2'.

Another difference from the version of FIG. 1 is the configuration of the guide grooves 23, 24 that cooperate with the guide pin 22 to offset the printing head 1' from its first transverse position into its second transverse position or from its second transverse position into its first transverse position. These guide grooves 23, 24 each have only one guide surface 25 and 26 for the transverse offsetting of the printing head 1' that runs at an inclination to the first direction 11', 12' and against which the guide pin 22 is prestressed by the spring 20. A deflector 27 is again provided in the region of the first guide groove 23 and corresponds in its function to the deflector 13 from FIG. 1.

Figure 3:
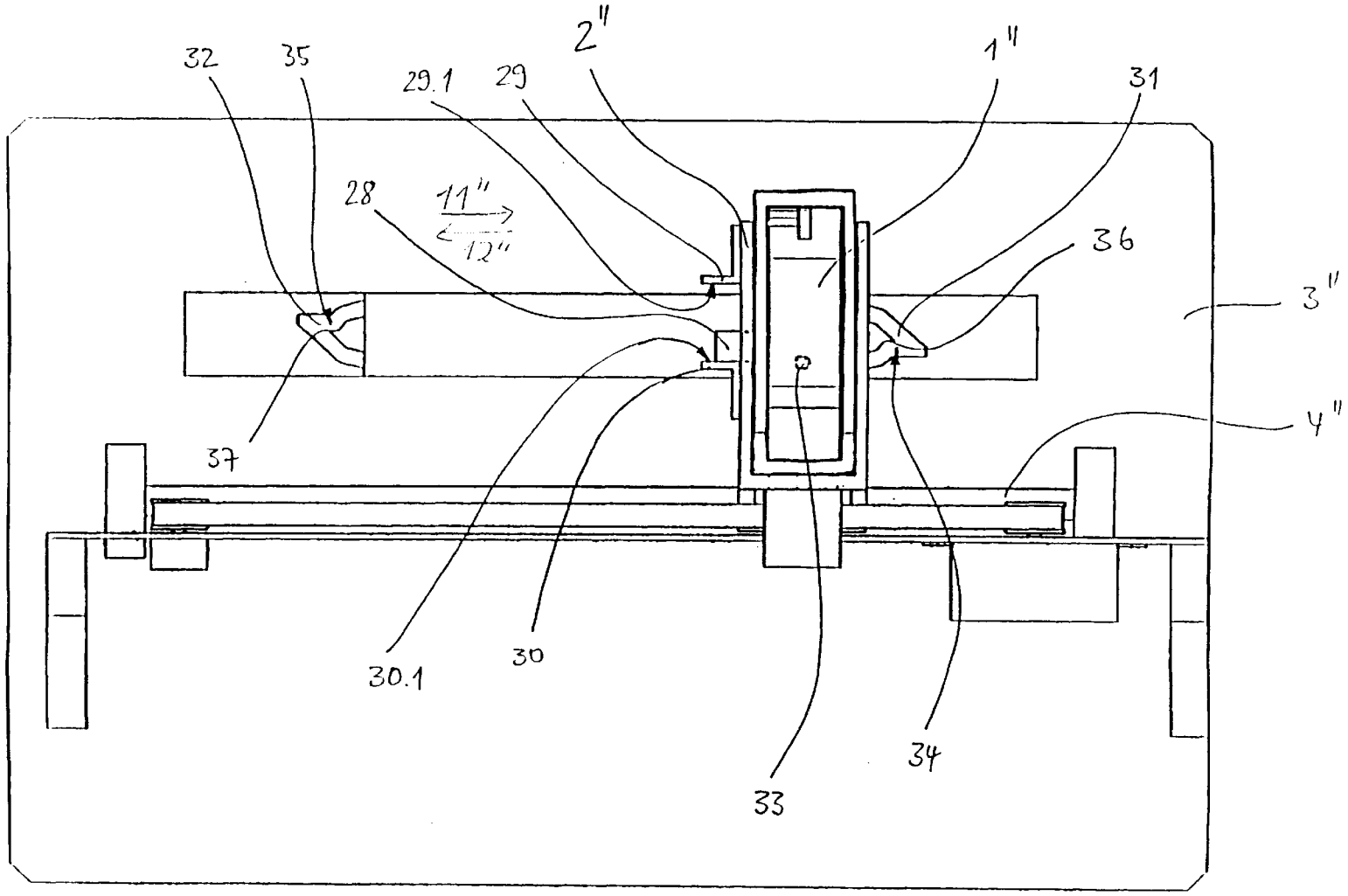
FIG. 3 is a plan view a third exemplary embodiment of the apparatus of FIG. 1.

FIG. 3 shows a top view of a third exemplary embodiment of the apparatus according to the invention. The basic makeup of the embodiment is identical to that from FIG. 1. Thus, only the differences are discussed.

One difference lies in the configuration of the first and second holding devices. The holding devices are formed by a magnet 28 and two angle pieces 29 and 30 made of a magnetic metal. The magnet 28 is connected to the printing head 1" and runs in a recess in the printing-head mounting 2". The recess extends in the offsetting direction of the printing head 1". The angle pieces 29 and 30 are disposed on the printing-head mounting 2" and respectively form a stop for the magnet 28 for limiting the printing-head movement transversely to the first direction 11", 12". They each have, for such a purpose, a stop surface 29.1 and 30.1.

The magnetic force acting between the magnet 28 and the respective angle piece 29, 30 constitutes the contact force that acts upon the respective stop and that holds the printing head in the respective transverse position.

It goes without saying that, in other versions, the angle pieces or an element corresponding to these may also be configured as a magnet with a corresponding element made of a magnetically soft metal or the like then being connected to the printing head.

Another difference is in the guide grooves 31, 32 that, in order to offset the printing head 1" from its first transverse position into its second transverse position or from its second transverse position into its first transverse position, cooperate with the guide pin 33 disposed on the underside of the printing head 1".

The guide grooves 31, 32 are essentially V-shaped. In the transitional region of their legs, the guide grooves 31, 32 have a lead device 34, 35 that ensures the printing head 1", when being moved in the first direction 11", 12", is offset from its first transverse position into its second transverse position or from its second transverse position into its first transverse position.

At the same time, the lead device 34, 35 has a run-on region 36, 37 that is offset, in the opposite sense to the respective offsetting direction of the printing head 1", relative to the transverse position that the printing head 1" has reached during movement in the first direction 11", 12" at the point in time of the reversal of the movement in the first direction 11", 12".

Because, in the present variant, the printing head 1" is not prestressed against the printing-head mounting 2" by any spring or the like, during the reversal of movement it remains in the transverse position and subsequently runs against the respective run-on region 36, 37.

In order to reduce the influence of any jerks or the like, at the same time, a frictional force counteracting the relative movement can act by virtue of the selected fit between the printing head 1" and the printing-head mounting 2". The printing head 1" may likewise be held in the transverse position as a neutral position in relation to the printing-head mounting 2" by spring devices or the like that counteract one another.

It goes without saying that the offset of the run-on edges formed for the guide pin 33 by the run-on region 36, 37 in relation to the transverse location of the guide pin 33 in the respective transverse position must only be such that, after reversal of movement, the guide pin 33 is deflected further in the desired offsetting direction of the printing head 1" by the respective run-on edge.

Figure 4:
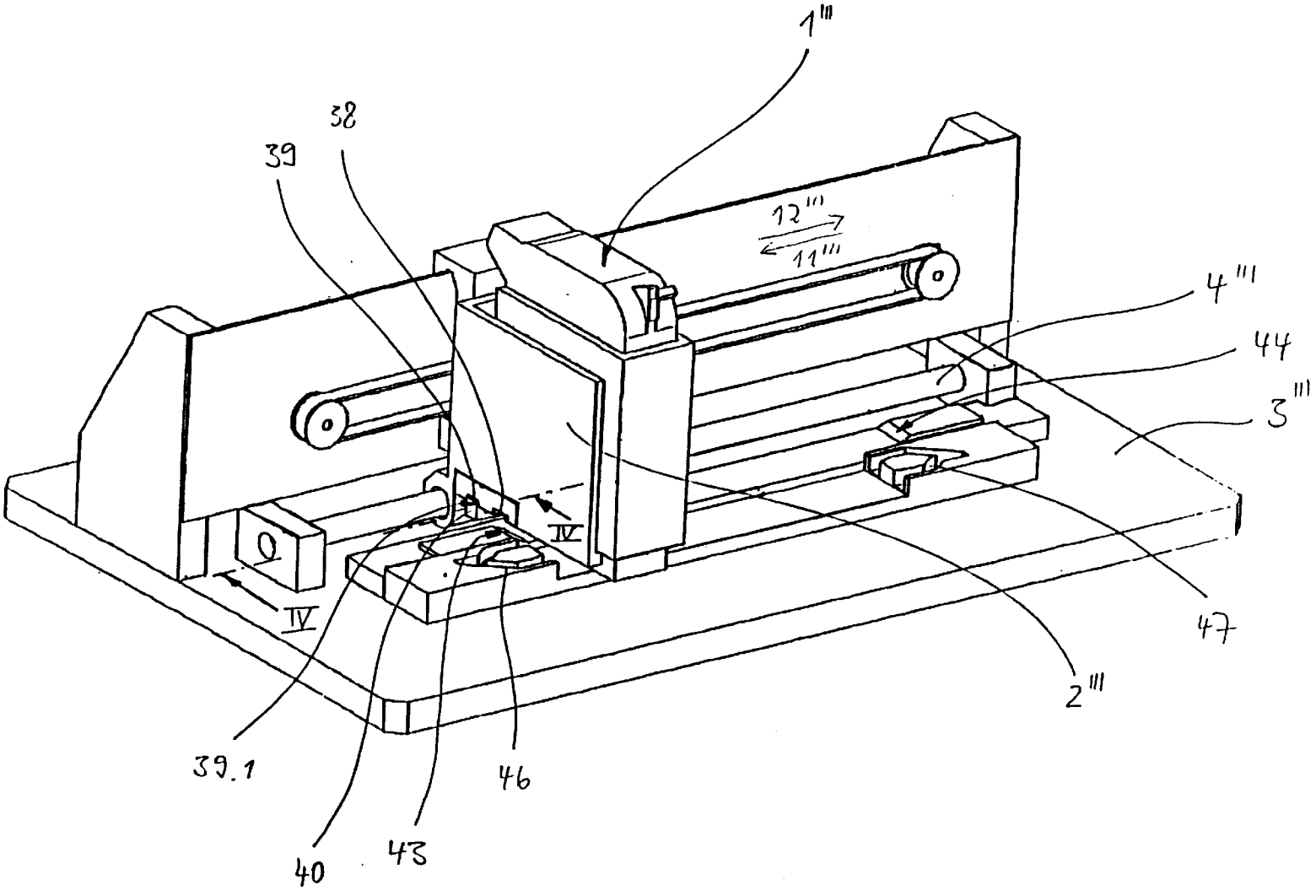
FIG. 4 is a perspective view of a fourth exemplary embodiment of the apparatus of FIG. 1.

FIG. 4 shows a perspective view of a fourth exemplary embodiment of the apparatus according to the invention. The basic makeup of the fourth embodiment is identical to that from FIG. 3. Thus, only the differences are discussed.

A difference is the configuration of the first and second holding devices, which are formed by grooves 38, 39 disposed on the printing-head mounting 2'" and by a locking element 40 (see FIG. 5) that can engage into the respective groove 38, 39 to hold the printing head 1'" positively in its respective transverse position.

In the absence of any action by other devices, such as the locking element, etc., the printing head 1'" is held relative to the printing-head mounting 2'" in a neutral position, located in the middle between the first and second transverse positions, by non-illustrated spring devices that counteract one another.

Figure 5:
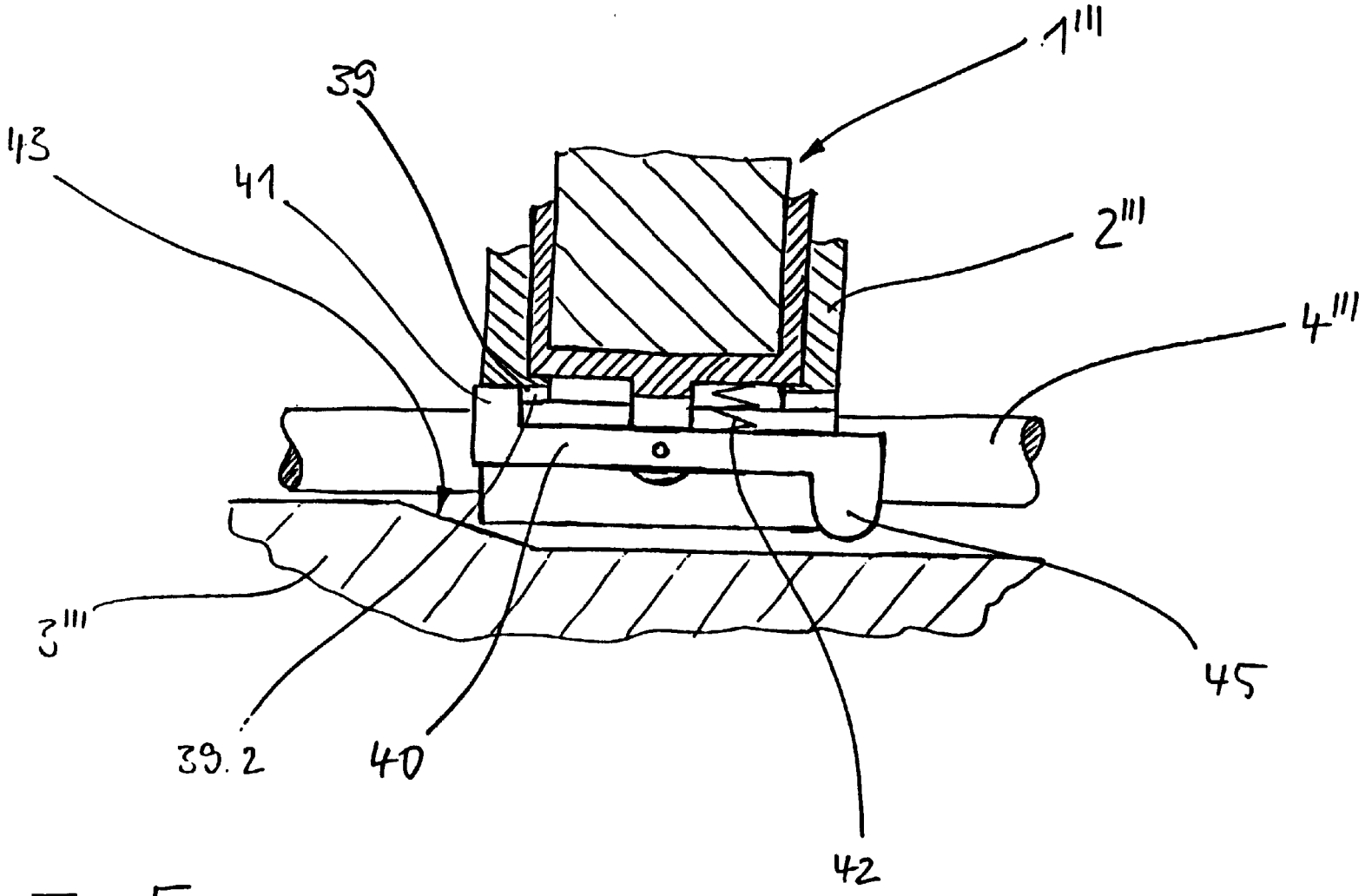
FIG. 5 is a diagrammatic, fragmentary, cross-sectional view of the apparatus of FIG. 4 along a line IV—IV in FIG. 4.

As may be gathered from FIG. 5, a hook-shaped lever 40 that is articulated on the underside of the printing head 1" forms the locking element'. The first free end 41 of hook-shaped lever 40 engages into the grooves 39 of the second holding device. The lateral surface 39.1 of the groove 39 located opposite the lateral surface 39.2 forms, for the lever 40, a stop that limits the transverse movement of the printing head 1'" transversely to the first direction 11'", 12'".

The lever 40 is prestressed toward the printing head by a spring 42 such that the lever 40 is held in its position of engagement into the groove 39, 38. To offset the printing head transversely to the first direction, the lever must be released from its engagement with respective groove 38, 39. The release is carried out, during the movement of the printing-head mounting 2" in the first direction, by ramps 43, 44 disposed on the base element 3'" and against which the second free end 45 of the lever 40 runs. See FIG. 5. The ramps are disposed such that the lever 40 is released from the respective groove 38, 39 only when a non-illustrated guide pin is already in engagement with the respective guide groove 46, 47 in order to offset the printing head 1" from its first transverse position into its second transverse position or from its second transverse position into its first transverse position. This takes place to ensure that the guide pin also actually comes into engagement with the guide grooves.

When the printing head is offset into its other transverse position by the respective guide groove 46, 47 and the second free end 45 of the lever 40 runs off the respective ramp again, the first free end 41 of the lever 40 automatically comes into engagement with the other groove 39, 38 by the spring 42. Then, the printing head 1'" is held in its other transverse position.

It goes without saying that, in other variants, the lever may also be disposed on the printing-head mounting and the grooves on the printing head. Furthermore, the spring devices for prestressing the printing head against the printing-head mounting may also be dispensed with. In such an embodiment, it is then advantageous to provide a correspondingly exact fit between the lever and grooves for the exact positioning of the printing head in the respective position in order to keep the play during positioning within an acceptable scope.

Moreover, the above mentioned variants for holding the printing head in its transverse position may be combined with one another in any desired way. Thus, for example, the printing head may be held in its first transverse position by magnetic action and in its second position by a corresponding locking element, etc.

In all the exemplary embodiments described above, the offsetting device is configured such that the offset of the printing head achieved transversely to the first direction is such that the two printing images generated during the movement of the printing-head mounting between the first and second longitudinal positions, and vice-versa, overlap one another at most in an edge region in which they are contiguous to one another transversely to the first direction. Ideally, there is no overlap. The two printing images complete one another to form an entire impression that, depending on the overlap, has approximately double the dimension of the printing images transversely to the first direction.

The exemplary embodiments described above are each related to offsetting devices that provide for offsetting the printing head and offsetting it back between a first and a second transverse position. It goes without saying, however, that further offsetting devices of the type described may also be provided, in order to offset the printing head transversely to the first direction between more than two transverse positions. They may be configured such that the printing head executes a serpentine or meandering movement during the printing of more than two printing images contiguous to one another transversely to the first direction. For returning to the initial position, either a separate offsetting device may then be provided or the offsetting distance can be covered in the opposite direction.

The invention is not restricted to the exemplary embodiments presented above. On the contrary, a number of variants may be envisaged that implement the invention even in a version differing from that described herein.

We claim:

1. An apparatus for printing, comprising:

a base element;

a printing-head mounting moveably connected to said base element;

a printing head displaceably connected to said printing-head mounting;

said printing-head mounting configured to move, during printing, between a first longitudinal position and a second longitudinal position in a given direction with respect to said base element to effect a relative movement between said printing head and a medium to be printed;

an offsetting device for printing images offset to one another transverse to said given direction, said offsetting device configured to off set said printing head relative to said printing-head mounting from a first transverse position into at least one second transverse position spaced from said first transverse position in a direction transverse to said given direction; and a holder for holding said printing head in at least one of said first transverse position and said second transverse position during printing, said holder having at least one first holding device and at least one second holding device, each of said at least one first holding device and said at least one second holding device having at least one stop for limiting movement of said printing-head transverse to said given direction, said holder including a force member for providing a contact force, said at least one first holding device being configured to hold said printing head in at least one of said first and second transverse positions by said contact force acting on said stop, and said force member being a magnetic device.

2. The apparatus according to claim 1, wherein said at least one first holding device has a stop with a stop surface, and said stop is disposed on said printing-head mounting.

3. The apparatus according to claim 1, wherein said at least one second holding device has a second stop with a second stop surface, and said second stop is disposed on said printing-head mounting.

4. The apparatus according to claim 3, wherein said at least one second holding device is configured to hold said printing head in one of said first and second transverse positions by said contact force acting on said second stop.

5. The apparatus according to claim 3, including a locking element, said at least one second holding device being configured to hold said printing head in one of said first and second transverse positions by a positive connection of said locking element.

6. The apparatus according to claim 5, wherein said at least one second holding device is configured to automatically lock said locking element when a respective one of said first and second transverse positions is reached.

7. The apparatus according to claim 1, wherein said at least one second holding device includes a longitudinal guide device and another longitudinal guide device cooperating with said longitudinal guide device for guiding said printing head essentially parallel to said given direction, and one of said longitudinal guide device and said another longitudinal guide device is disposed on said base element.

8. The apparatus according to claim 7, wherein said longitudinal guide device has at least one longitudinal guide surface essentially parallel to said given direction, and said another longitudinal guide device is a longitudinal guide element configured to cooperate with said at least one longitudinal guide surface for holding said printing head in at least one of said first and second transverse positions.

9. The apparatus according to claim 7, wherein said longitudinal guide device is a longitudinal guide groove and said another longitudinal guide device is a longitudinal guide pin.

10. The apparatus according to claim 8, wherein said longitudinal guide device is a longitudinal guide groove and said another longitudinal guide device is a longitudinal guide pin.

11. The apparatus according to claim 7, wherein said another longitudinal guide device is disposed on said base element and extends at least in a region between said first longitudinal position and said second longitudinal position of said printing-head mounting.

12. A franking machine, comprising:

a base element;

a printing-head mounting moveably connected to said base element;

a printing head displaceably connected to said printing-head mounting;

said printing-head mounting configured to move, during printing, between a first longitudinal position and a second longitudinal position in a given direction with respect to said base element to effect a relative movement between said printing head and a medium to be printed;

an offsetting device for printing images offset to one another transverse to said given direction, said offsetting device configured to offset said printing head relative to said printing-head mounting from a first transverse position into at least one second transverse position spaced from said first transverse position in a direction transverse to said given direction; and a holder for holding said printing head in at least one of said first transverse position and said second transverse position during printing, said holder having at least one first holding device and at least one second holding device, each of said at least one first holding device and said at least one second holding device having at least one stop for limiting movement of said printing-head transverse to said given direction, said holder including a force member for providing a contact force, said at least one first holding device being configured to hold said printing head in at least one of said first and second transverse positions by said contact force acting on said stop, and said force member being a magnetic device.

13. A franking machine, comprising:

a base element;

a printing-head mounting moveably connected to said base element;

a printing head displaceably connected to said printing-head mounting;

said printing-head mounting configured to move, during printing, between a first longitudinal position and a second longitudinal position in a given direction with respect to said base element to effect a relative movement between said printing head and a medium to be printed;

an offsetting device for printing images offset to one another transverse to said given direction, said offsetting device configured to offset said printing head relative to said printing-head mounting from a first transverse position into at least one second transverse position spaced from said first transverse position in a direction transverse to said given direction; and means for holding said printing head in at least one of said first transverse position and said second transverse position during printing, said holding means having at least one first holding device and at least one second holding device, each of said at least one first holding device and said at least one second holding device having at least one stop for limiting movement of said printing-head transverse to said given direction, said holding means including a force member for providing a contact force, said at least one first holding device being configured to hold said printing head in at least one of said first and second transverse positions by said contact force acting on said stop, and said force member being a magnetic device.

* * * * *